US005353760A

United States Patent [19]

Zager

[11] Patent Number: 5,353,760

[45] Date of Patent: Oct. 11, 1994

[54] MULTIPLE ENGINE OIL AND FUEL SYSTEM

[75] Inventor: Raymond Zager, Ponte Vedra Beach, Fla.

[73] Assignee: Ray Zager & Company, Ponte Vedra Beach, Fla.

[21] Appl. No.: 31,559

[22] Filed: Mar. 15, 1993

[51] Int. Cl.[5] ..... F01M 11/04

[52] U.S. Cl. ..... 123/196 S; 123/196 A; 184/1.5

[58] Field of Search ..... 123/196 S, 196 A, 196 R; 184/1.5

[56] References Cited

U.S. PATENT DOCUMENTS

| | | | |
|---|---|---|---|
| 4,240,523 | 12/1980 | Nestor et al. | 184/1.5 |
| 4,417,561 | 11/1983 | Yasuhara | 123/196 S |
| 4,421,078 | 12/1983 | Hurner | 123/196 S |
| 4,674,456 | 6/1987 | Merritt | 123/196 S |
| 4,869,346 | 9/1989 | Nelson | 123/196 S |
| 4,875,884 | 10/1989 | Meisenburg | 184/1.5 |
| 4,986,777 | 1/1991 | Preston | 184/1.5 |
| 5,069,259 | 12/1991 | Ahlefeld | 184/1.5 |
| 5,203,429 | 4/1993 | Zager | 184/1.5 |

*Primary Examiner*—E. Rollins Cross
*Assistant Examiner*—Erick Solis
*Attorney, Agent, or Firm*—Arthur G. Yeager; Earl L. Tyner

[57] ABSTRACT

A system for draining and filling oil reservoirs in the crankcases and the generators of marine vessels with at least one or two diesel engines, including a motor driven pump, conduits connecting the pump to the reservoirs of the generator and of each engine and with the fuel tanks, an oil sump of fresh oil, and selector valves to connect the conduits to the pump in a variety of combinations; one of which extracts used oil from the reservoirs and forces same through a filter/blender while receiving diesel fuel from a tank on board the vessel and returns the mixed used oil and fuel to the tank for subsequent combustion by the engine; a second of which provides fresh oil to the reservoirs; and a third of which provides diesel fuel to the tanks.

18 Claims, 1 Drawing Sheet

MULTIPLE ENGINE OIL AND FUEL SYSTEM

BACKGROUND OF THE INVENTION

This invention relates to engine maintenance equipment; and more particularly, to a system for a multiple diesel engine power plant in which used oil from the engines is blended with diesel fuel and the blend is used as fuel for the engines.

Changing crankcase oil in the engines of marine vessels where there is very little free space around the engines has always been a difficult problem in the absence of specialized service personnel. Electric motor driven pumps have been used in the past to pump drained oil to storage containers for subsequent disposal. There has not been available, however, a simple remotely controlled system to drain and refill oil from multiple marine engines, except for those disclosed and claimed in U.S. Pat. No. 4,240,523 and in my copending patent application Ser. No. 07/862,724 filed Apr. 3, 1992now U.S. Pat. No. 5,203,429. Both of these systems include a container to receive and contain used oil drained from the engines until the vessel reaches land and can find a disposal site for the used oil.

It is an object of this invention to provide a system for blending used oil from marine diesel engines with diesel fuel and using that blend as fuel for the engines. It is another object of this invention to provide a system for making such a blend periodically, consuming the blend as fuel, and adding fresh oil to the engines and the generator. Still other objects will become apparent from the more detailed description which follows.

BRIEF SUMMARY OF THE INVENTION

This invention relates to an internal combustion power plant involving a plurality of engines consuming as fuel a blend of used crankcase oil and diesel oil, wherein used oil from the engines is periodically filtered and blended with diesel oil and fed to the fuel tanks supplying the engines, all of which operations being accomplished by remote control of a network of conduits, valves, a reversible motor and pump, and a filter/-blender. In specific and preferred embodiments of this invention the conduits and valves connect the fuel tank and the oil pan of each engine to selector valves to direct the used oil and diesel oil to tile filter/blender and thence to the fuel tank of each engine.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
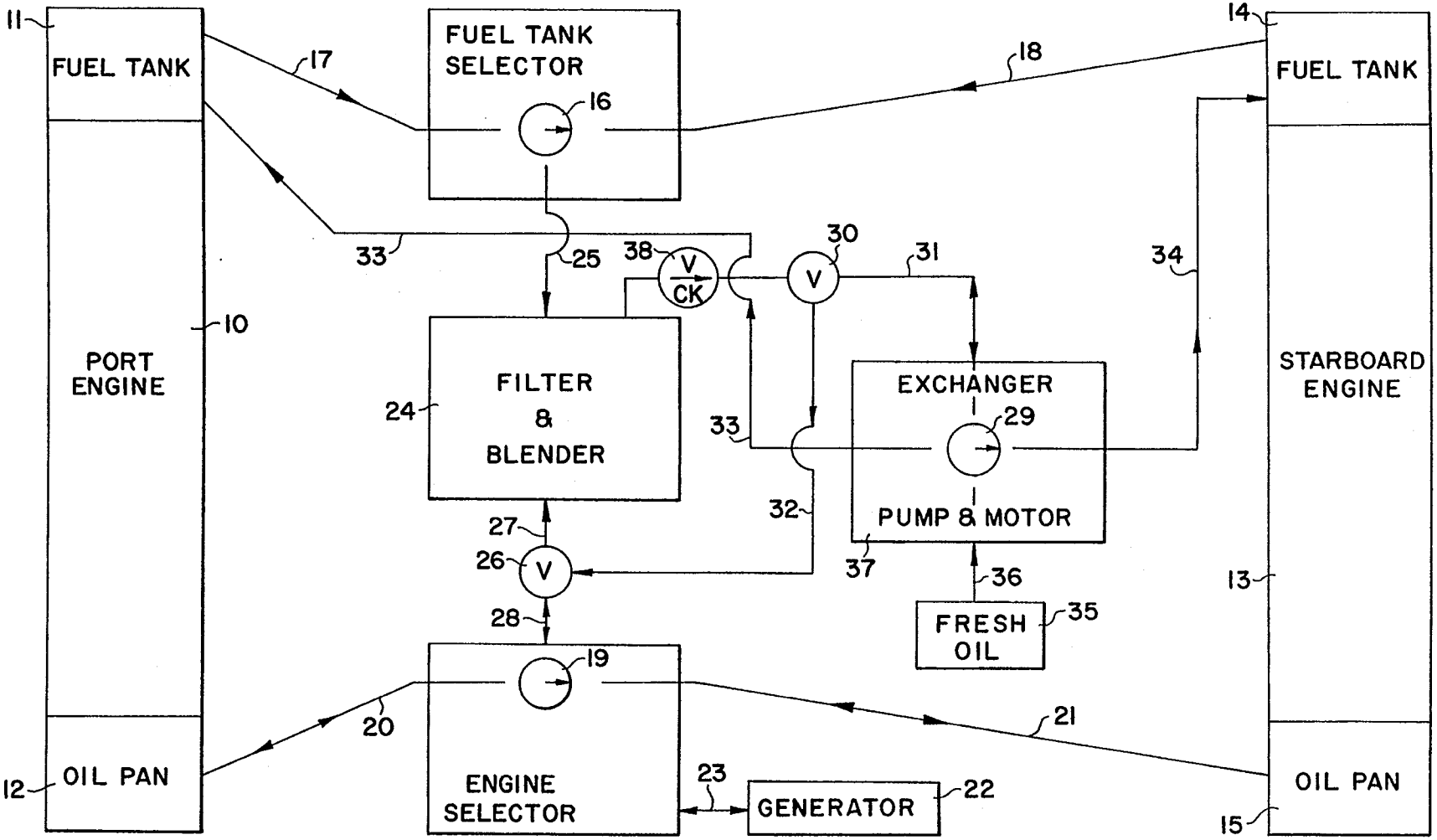
FIG. 1 is a schematic block diagram of the system of this invention as applied to a boat having a power plant including two diesel engines and a generator.

The system of this invention is best understood by reference to the attached drawing representing a block diagram of the invention in which the power plant includes two diesel marine engines and a generator.

There are shown in FIG. 1 port engine 10 and starboard engine 13, each of engines 10 and 13 having, respectively a fuel tank 11 and 14 and an oil pan 12 and 15. These are the component parts of tile engines that must be serviced by the system of this invention. Two principal pieces of equipment perform the needed services . Exchanger pump and motor 37 is one of these, and it includes a suitable reversible pump to drive the fluids, lubricating oil and fuel, through conduit piping to the desired locations. The pump must be driven by a suitable reversible electric motor. Neither the pump or the motor are specifically shown in the drawing because they are standard pieces of equipment available everywhere on the open market in different sizes and capacities as needed for engines 10 and 13 of various sizes. Basically the exchanger 37 is the same as that shown and described in U.S. Pat. No. 4,240,523. The input and output piping connected to exchanger pump and motor 37 are connected to valve 29 which directs flow in any of three directions that are selected by the operator of the system, about which more will be described later.

The second of the principal pieces of equipment is the filter/blender 24. This device is a filter for removing particles, sludge, and the like from the used oil coming from oil pans 12 and 15 and a blender or mixer to mix oil from the filter with diesel fuel from fuel tanks 11 and 14. The filter portion of 24 may be any suitable filter from the market, like diesel oil filters which contain replaceable filter cartridges. Other suitable filters are available having replaceable filter cloths, pads, papers, and/or other materials, so long as it is capable of removing particles, sludge, dirt, and any other contaminant from used oil. It is also possible that the filter may be used to filter objectionable contaminants from the diesel oil before it enters the blender portion of 24. It is also to be noted that additional fuel filters are normally provided between the fuel tank and the engine to further filter the fuel (with or without the used oil blended therewith).

The blender portion of 24 is also a device that is available on the open market today, generally being a high speed mixer capable of receiving two or more liquid components and mixing them into a single homogeneous liquid mixture. Filter/blender 24 is intended to be a combination of a filter and a blender as described and can be obtained from several commercial sources. The filter/blender preferably is arranged such that incoming oils pass through the filter portion first, and then are blended in the blender portion thereafter. There are two conduits or pipe lines leading into filter/-blender 24; namely, lines 25 and 27; and one pipe line leading away from filter/blender; namely, line 31. The operation and use of these lines will be described hereinafter.

The remaining significant components of the system of this invention are selector valves 16 and 19. The former is a valve 16 to select the source of diesel oil to be sent to filter/blender 24. There are two sources; namely, fuel tanks 11 and 14. The latter component is engine selector valve 19 which determines the source of used oil to be sent to filter/blender 24. There are three sources of used oil; namely, crankcase oil pans 12 and 15 and reservoir oil used to lubricate bearings of the generator 22.

There are two other control valves, 26 and 30, that have not yet been mentioned, but which are necessary to have a suitable network of piping and valves to operate the system in its various configurations.

The system of this invention is designed principally to provide an easy and efficient method to clean used lubricating oil and blend it with diesel fuel in the tanks on the marine vessel which can then be consumed as engine fuel. Generally, the amount of oil that can be mixed with diesel fuel without hampering the use of the mixture as acceptable fuel is about 5% by volume. Appropriate instruments or gauges can be added to this system to monitor that concentration and to adjust the operation of this system to maintain control. No such instrumentation is suggested here, since the system may be controlled manually or automatically as desired.

The operation of this system to produce a blend of used oil and diesel oil is accomplished as follows. Diesel oil is selected for blending by choosing any of the two sources, fuel tanks 11 or 14 by adjusting valve 16 to receive diesel oil from the chosen source through line 17 or 18, respectively, and direct the diesel oil to filter/-blender through line 25. Used oil is selected from any of the three sources, oil pans 12 or 15, and generator 22 by adjusting valve 19 to receive the used oil from the chosen source through lines 20, 21, or 23, respectively, and direct the used oil to filter/blender 24 through line 28, valve 26, and line 27. This used oil in line 27 enters into the filter portion of filter/blender 24 before entering into the blender portion, while the fuel tank oil may, if desired, bypass the filter portion of filter/blender 24.

Filter/blender 24 cleans the used oil and also the diesel oil, and blends the cleaned oil with the diesel oil from line 25 to produce a modified fuel having not more than about 5% by volume filtered oil with the remainder being diesel oil. This modified fuel passes through line 31 and valve 30 to exchanger valve 29 which is positioned to direct it to either fuel tank 11 or 14 through lines 33 or 34, respectively. The check valve 38 inhibits any oil flow back through line 31 and valve 30 into filter/blender 24, i.e., to assure that the fresh oil can only be directed to one of the oil pans 12 or 15. The pump and motor of exchanger 37 provide the driving force to conduct the liquids through this network.

There is another operation available to the operator through this network involving the replenishment of the oil in the engines 10 and 13 and in generator 22. This operation requires a source of fresh or clean oil 35 which is connected through line 36 to exchanger valve 29. In this operation the pump and motor of exchanger is reversed so as to pump outwardly through line 31 with its suction side being line 36. Valve 30 is adjusted to direct oil from line 31 into line 32 and to valve 26 which is adjusted to direct the oil through line 28 to engine selector valve 19. Selector valve 19 is adjusted by the operator to direct the fresh oil to any of the three devices that might need the oil; namely, engines 10 and 13 and generator 22. The drawing actually shows lines 20 and 21 as being used for directing the fresh oil to the crankcase or oil pans 12 and 15.

If desired a more complete system may include the exchanger as shown and described in my U.S. application Ser. No. 07/862,724 which would include the transmissions so that the transmission oil may be changed and used transmission oil blended with the diesel fuel in much the same manner as described hereinabove.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an internal combustion power plant for a marine vessel having a plurality of engines consuming from fuel tanks a blend of used crankcase oil and diesel oil, a system for preparing said blend comprising a filter/-blender means for periodically receiving used crankcase oil from selected said engines and diesel oil from selected said fuel tanks of said engines, said filter/blender filtering said used crankcase oil and mixing same with said diesel oil and feeding the mixture to said selected fuel tank.

2. The power plant of claim 1 further including a fuel tank selector valve having a plurality of selective positions to respectively connect said fuel tank of any said engines to said filter/blender means.

3. The power plant of claim 1 further including an engine selector valve having a plurality of selective positions to connect selected said engines to said filter/-blender means to supply said used crankcase oil.

4. The power plant of claim 3 wherein said engine selector valve also includes a position to connect an oil reservoir of a generator to said filter/blender means.

5. The power plant of claim 1 further including a reversible pump and a reversible motor and a network of conduits and valves connecting said pump to said fuel tanks and each of said engines and to said filter/blender means.

6. The power plant of claim 1 further including means for selectively pumping fresh oil to each said engine.

7. A fuel and lubricating system for a marine vessel having a power plant including a pair of diesel engines each with its own fuel tank and oil pan, the system including:

a. a filter/blender adapted to filter used oil and diesel fuel and to blend said used oil and diesel fuel to a homogeneous mixture;

b. a reversible drive motor and pump for pumping said used oil and diesel fuel;

c. a first selector valve with conduits connecting said first valve to said fuel tank of each said engine and to said filter/blender;

d. a second selector valve with conduits connecting said second valve to said oil pan of each said engine and to said filter/blender; and e. a network of conduits and other valves to selectively connect said pump to a source of fresh oil and to said filter/blender to pump said blend of used oil and diesel fuel to said fuel tank of any said engine.

8. The system of claim 7 wherein said first valve additionally selectively connects a reservoir of a generator containing used lubricating oil to said filter/-blender.

9. A method of disposing of used oil from at least one diesel engine on a marine vessel comprising the steps of:

a) periodically suctioning from a crankcase of the engine used oil;

b) passing the suctioned used oil through a filter;

c) blending the filtered used oil with diesel fuel extracted from a fuel tank supplying the engine; and d) returning the blended used oil and diesel fuel to a fuel tank to be subsequently consumed by the engine of the vessel.

10. The method of claim 9 further including the step of:

e) suctioning from a reservoir of a generator used lubricating oil;

f) repeating steps b, c and d with respect to the suctioned used lubricating oil.

11. In an internal combustion power plant for a marine vessel having at least one diesel engine consuming as fuel diesel oil and/or a blend of used crankcase oil and diesel oil in at least one fuel tank, a system for periodically preparing a blend of used oil and diesel oil, said system comprising a filter/blender means for periodically receiving used crankcase oil from said at least one said engine, pump means for passing diesel oil from said fuel tank supplying said at least one said engine through said filter and blender means, said filter and blender means filtering said used crankcase oil and mixing same with said diesel oil, said pump means feeding the mixture of said filtered crankcase oil and diesel oil to said at least one fuel tank.

12. The power plant of claim 11 further including another fuel tank and a fuel tank selector valve means having a plurality of selective positions to selectively connect said at least one and said another fuel tanks to said filter/blender means.

13. The power plant of claim 11 further including another engine and an engine selector valve means having a plurality of selective positions to selectively connect said at least one engine and said another engine used crankcase oil to said filter/blender means.

14. The power plant of claim 13 wherein said selector valve means selective positions includes a used oil reservoir of a generator of said power plant.

15. The power plant of claim 11 wherein said pump means includes a reversible pump and a reversible motor and a network of conduits and valves connecting said pump to said at least one fuel tank and said at least one said engine and to said filter/blender means.

16. The power plant of claim 11 which additionally includes means for pumping fresh crankcase oil to said at least one engine.

17. A fuel and lubricating system for a marine vessel having a power plant including a pair of diesel engines each with its own fuel tank and oil pan, the system including:

a. a filter/blender adapted to filter used oil and diesel fuel and to blend said used oil and diesel fuel to a homogeneous mixture;

b. a reversible drive motor and pump for said used oil and diesel fuel;

c. a first selective valve with conduits connecting said first valve to said fuel tank of each said engine and to said filter/blender;

d. a second selective valve with conduits connecting said second valve to said oil pan of each said engine and to said filter/blender; and e. a network of conduits and other valves to selectively connect said pump to a source of fresh oil and to said filter/blender to pump said blend of used oil and diesel fuel to said fuel tank of any said engine.

18. The system of claim 17 wherein said first valve selectively connects a generator reservoir having used lubricating oil to said filter/blender.

* * * * *